United States Patent [19]

Borjesson

[11] Patent Number: 4,893,737

[45] Date of Patent: Jan. 16, 1990

[54] DISPENSING APPARATUS

[75] Inventor: Hans Borjesson, Hestra, Sweden

[73] Assignee: AB Ernol, Hestra, Sweden

[21] Appl. No.: 54,566

[22] PCT Filed: Sep. 22, 1986

[86] PCT No.: PCT/SE86/00423

§ 371 Date: Jun. 30, 1987

§ 102(e) Date: Jun. 30, 1987

[87] PCT Pub. No.: WO87/02013

PCT Pub. Date: Apr. 9, 1987

[30] Foreign Application Priority Data

Sep. 25, 1985 [SE] Sweden ..... 8504424

[51] Int. Cl.[4] ..... G01F 11/10

[52] U.S. Cl. ..... 222/360; 222/370; 192/46; 74/142

[58] Field of Search ..... 222/370, 345, 342, 302, 222/360, 355, 367, 368, 359, 410; 221/265; 74/142; 192/46

[56] References Cited

U.S. PATENT DOCUMENTS

| | | | |
|---|---|---|---|
| 510,294 | 12/1893 | Richards | 222/360 |
| 532,670 | 1/1895 | Kelsey | 192/46 |
| 853,768 | 5/1907 | Caviglia | 222/360 X |
| 1,778,845 | 10/1930 | Brunhoff | 222/360 X |
| 1,906,664 | 5/1933 | Thorne | 222/302 X |
| 2,196,721 | 4/1940 | Boyle | 222/302 |
| 2,878,970 | 3/1959 | Dobkin | 222/370 X |
| 3,118,575 | 1/1964 | McCauley | 222/368 X |
| 3,266,677 | 8/1966 | Hamilton . | |
| 3,308,995 | 3/1967 | Lee et al. . | |
| 4,155,228 | 5/1979 | Burgener, Jr. et al. | 192/46 X |
| 4,155,486 | 5/1979 | Brown | 222/368 X |
| 4,511,067 | 4/1985 | Martin et al. | 222/368 X |

FOREIGN PATENT DOCUMENTS

| | | | |
|---|---|---|---|
| 259164 | 6/1928 | Italy | 222/370 |
| 598847 | 10/1959 | Italy | 222/370 |
| 761354 | 11/1956 | United Kingdom | 222/370 |
| 801022 | 9/1958 | United Kingdom | 222/360 |
| 2178397 | 2/1987 | United Kingdom | 222/370 |

*Primary Examiner*—H. Grant Skaggs

*Attorney, Agent, or Firm*—Beveridge, DeGrandi & Weilacher

[57] ABSTRACT

A dispenser for goods such as coffee has a container with a discharge opening in its bottom, a rotor which covers the bottom of the container and is provided with vanes which define a plurality of dispensing compartments, and a wiper which covers the rotor in the vicinity of the discharge opening. A drive mechanism with a stepwise pivoting action is operable to move one dispensing compartment at a time to the discharge opening. The lower surface of each vane has a leading edge which contacts the container bottom, and there is a rake space between this lower surface and the bottom of the container. The wiper extends up to intersect the container wall at an acute angle to prevent the goods from rotating with the rotor.

4 Claims, 4 Drawing Sheets

DISPENSING APPARATUS

TECHNICAL FIELD

The present invention relates to an apparatus for dispensing a pulverulent goods, for example ground coffee, and comprising a container for the goods, a movable discharge device with at least one accommodation compartment for the goods, the discharge device being movable between one position for replenishment of the accommodation compartment from the container, and a position for discharging the goods accommodated in the accommodation compartment.

BACKGROUND ART

In this art, a number of different discharging or dispensing apparatuses are previously known which have been intended for the discharge of determined quantities on each discharge occasion of the goods stored in the discharge apparatus. As one example of such prior art constructions, mention might be made of a container which, in its lower region, is provided with a transverse feeder screw which, on its rotation, dispenses a predetermined amount of goods depending upon the number of turns through which the screw is rotated.

Dispensing apparatuses are also previously known in the art which, in a bottom region of a container, have been provided with reciprocally movable discharge devices with a compartment for accommodating a certain quantity of the goods located in the container. After displacement, preferably in the horizontal direction, of the discharge device, the compartment with the goods quantity is shifted in beneath some form of wiper tool in order subsequently to be passed over a discharge opening through which the goods quantity falls out.

There are also previously known in the art dispensing apparatuses which have been provided with a piston reciprocally movable in a cylinder, the cylinder being, in its side wall, provided with a port or opening in communication with the container. On protraction of the cylinder so that the port is exposed, the contents of the container fall or run down into the cylinder and fill the cylinder with a certain quantity, whereafter the piston is retracted so that the quantity located in the cylinder is positively ejected.

PROBLEM STRUCTURE

Dispensing apparatuses of the type intimated by way of introduction may function satisfactorily in many contexts, but only when the goods in question consist of a liquid or a pulverulent material which possesses good free-flowing properties. However, in such situations when the goods have manifest tendencies to lump together, to form arches or bridges over a downwardly directed opening, or to ad. here to the inner walls of the container, the prior art apparatuses have proved to be wholly inadequate. As a typical example of pulverulent goods with seemingly unmanageable properties, mention might be made of ground coffee, since, first, the particles are unctuous, and, secondly, sharp-edged in their contours, with the result that the particles adhere both to one another and to other objects, and in addition, because of their particulate shape, the particles suffer from markedly poor free-flowing properties. Hence, the dispensing of ground coffee cannot be effected using any of the prior art dispensing apparatuses.

OBJECT OF THE INVENTION

The object of the present invention is to design the apparatus intimated by way of introduction such that it may also be used for unmanageable goods such as, for example, ground coffee. The invention also has for its object to realise an apparatus which permits reliable and dependable dispensing, with dispensed quantities of equal size on each dispensing occasion. Finally, the invention further has for its object to design the apparatus such that the dispensing operation may be effected with full dispensed batches right up to that moment when the receptacle container for the goods is empty.

SOLUTION

The objects forming the basis of the present invention are attained if the apparatus intimated by way of introduction is characterised in that the discharge device is in the form of a rotor which covers substantially the whole of the bottom of the container, and which has a number of upstanding vanes which therebetween form the accommodation compartments; that the bottom is provided with a discharge opening over which the accommodation compartments may be moved, a portion of the rotor in the region of the discharge opening being upwardly covered by means of a wiper device.

One preferred embodiment of the invention is suitably characterised in that the rotor is connected to a drive mechanism which is operative to stepwise turn the rotor through such an angle as corresponds to one accommodation compartment, and after one such rotational step, to leave the rotor in a position with an accommodation compartment substantially in register over the discharge opening.

In order to ensure that no direct passage of the contents of the container may take place from the container to the discharge opening, but also in order to ensure that supply to the accommodation compartments is guaranteed in the container, the preferred embodiment of the present invention is also characterised in that the wiper device has a downface contour which is shaped so as to cover three adjacent accommodation compartments, and that the wiper device is provided with a wall facing towards the interior of the container, the wall tapering upwardly and joining the inside of the container at an acute angle.

A modified embodiment of the present invention is characterised in that the rotor is provided with further projecting vanes which are placed and shaped so as to brush against upwardly or inwardly facing surfaces of the wiper device.

Further advantages will be attained according to the present invention if this is also given any one or more of the characterising features as set forth in claims 4 and 6.

BRIEF DESCRIPTION OF THE ACCOMPANYING DRAWINGS

The nature of the present invention and its aspects will be more readily understood from the following brief description of the accompanying Drawings, and discussion relating thereto.

In the accompanying Drawings:

FIG. 1 schematically illustrates a diametric and vertical cross-section through the subject matter of the present invention;

DESCRIPTION OF PREFERRED EMBODIMENT

Figure 1:
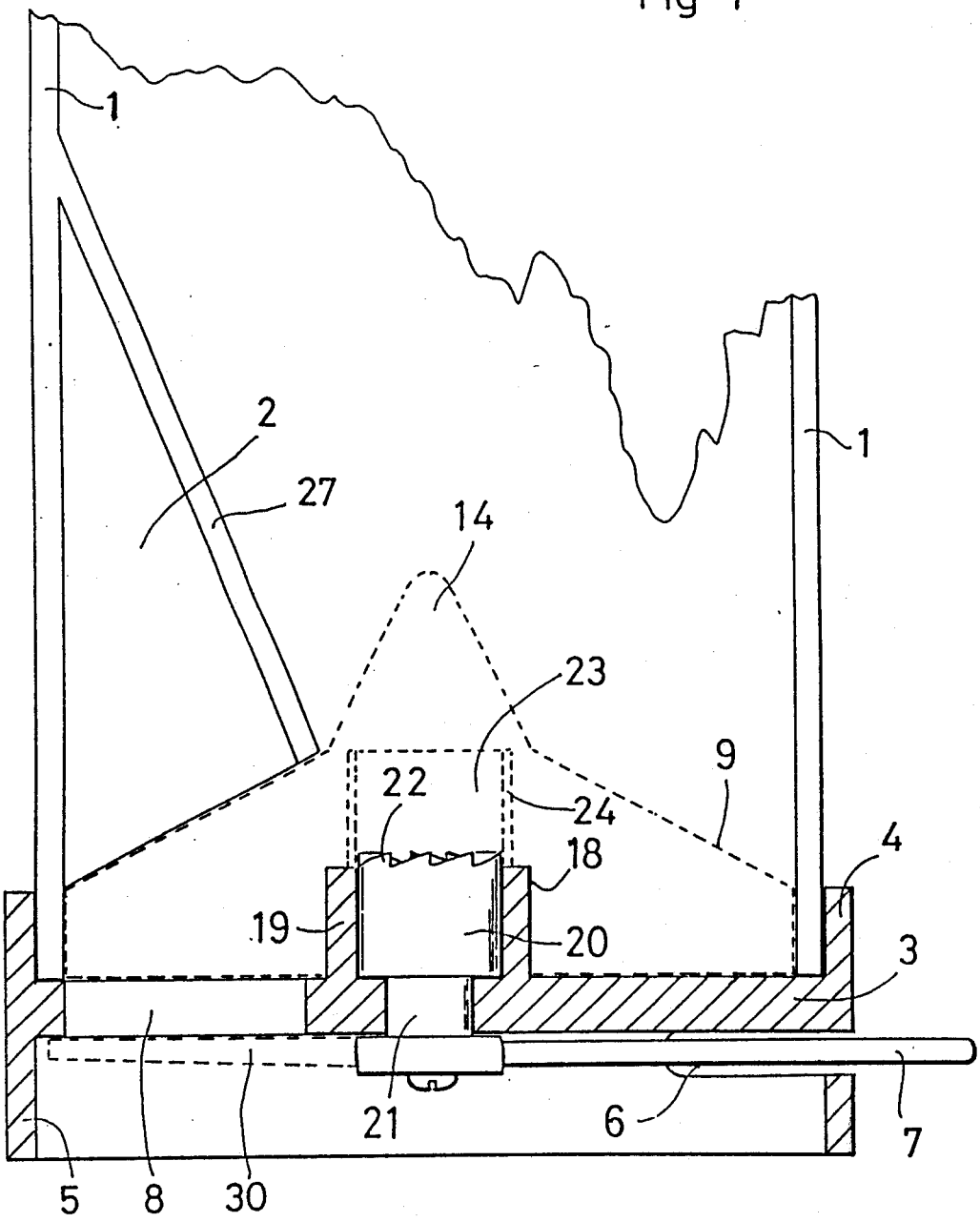

Referring to the Drawings, FIG. 1 shows a vertical and substantially diametric cross-section through a dispensing apparatus according to the invention. This dispensing apparatus includes a container 1 which, interiorly, is substantially cylindrical, apart from the presence of a wiper device 2. The dimensions of the container are suitably selected such that, in particular if it is to be employed for the storage and dispensing of ground coffee, the contents of a standard-size package of coffee can be accommodated in the container.

The cylindrical side wall of the container is terminated downwardly by means of a bottom portion 3 which has an upwardly directed, annular wall portion 4 which surrounds a lower edge portion of the container 1 and is fixedly retained therein by suitable means, for example, by threading, bayonet catches, snap-action catches or the like. The bottom portion 3 is further provided with a downwardly directed, annular wall portion 5 which, along a part of its periphery, is provided with an opening 6 through which extends an operating lever 7. Finally, the bottom portion 3 is also provided with a discharge opening 8 whose size, configuration and disposition will be dealt with in greater detail below.

Interiorly in the container 1, and immediately above its bottom portion 3, there is disposed a rotor whose side projection is apparent by broken lines 9. As will be apparent from FIGS. 3 and 4, which more clearly illustrate the design of the rotor, the rotor is provided with a number of projecting vanes 10 which therebetween form a number of accommodation and dispensing compartments 11 of equal size — hereinafter, for purposes of clarity, being designated accommodation compartments — for the goods located in the container 1 and to be discharged from the container in accurately adapted quantities. Furthermore, the rotor is provided in its center with a hub 12 which has a downwardly open recess 13. The upper portion of the hub 12 is designed as an approximately conical and upwardly directed boss 14 with a relatively acute conical angle, while the upper defining edges 15 of the vanes 10 lie in a conical surface of a considerably more obtuse conical angle.

As is apparent from FIG. 1, the rotor 9 abuts with high-class fit against the upper side of the bottom portion 3. The rotor and its vanes 10 may have planar underface, but may also be of other configuration, as will be described in greater detail below. Further, the radially outer end surfaces 16 of the vanes 10 brush against the inner wall of the container 1. The recess 13 has an outer portion with a journalling surface 17, by means of which the rotor 9 is journalled on a journalling surface 18 on a substantially cylindrical journal 19 disposed on the bottom portion 3.

The journal 19 is in the form of a fistular sleeve which accommodates, in its interior, a coupling member 20 which, by the intermediary of a shaft section 21, is interconnected with the operating lever 7. In this instance, the connection may — as opposed to that shown on the Drawing — be realised by some form of snap-action coupling or the like, such that mounting of the operating lever 7 on the shaft section 21, produced in one-piece construction with the coupling member 20, will be facilitated. By sweeping the operating lever 7 reciprocally in the opening 6, the coupling member 20 will, thus, be caused to pivot about its center axis through an angle which corresponds to the center angle of the opening 6. The size of this angle depends upon the number of vanes 10 on the rotor, such that the center angle of the opening is of the same magnitude as the angle between two mutually adjacent vanes.

At is upper end, the coupling member 20 is provided with a collar of cuneiform coupling teeth 22 which are the same in number as the number of vanes 10 on the rotor 9.

Figure 3:
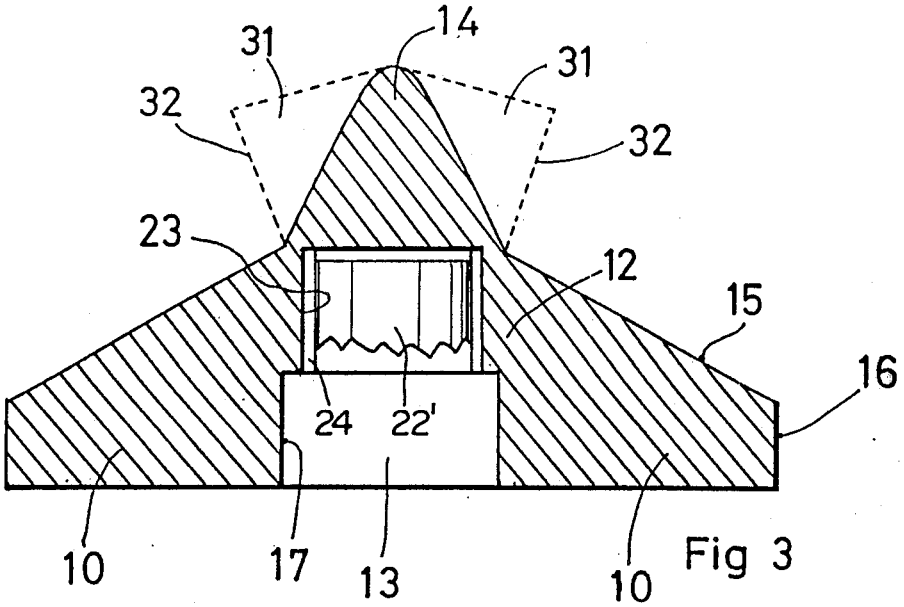
FIG. 3 shows a vertical and diametric cross-section according to the sectional indication A—A in FIG. 4 through the rotor also intimated by broken lines in FIG. 1.
Figure 4:
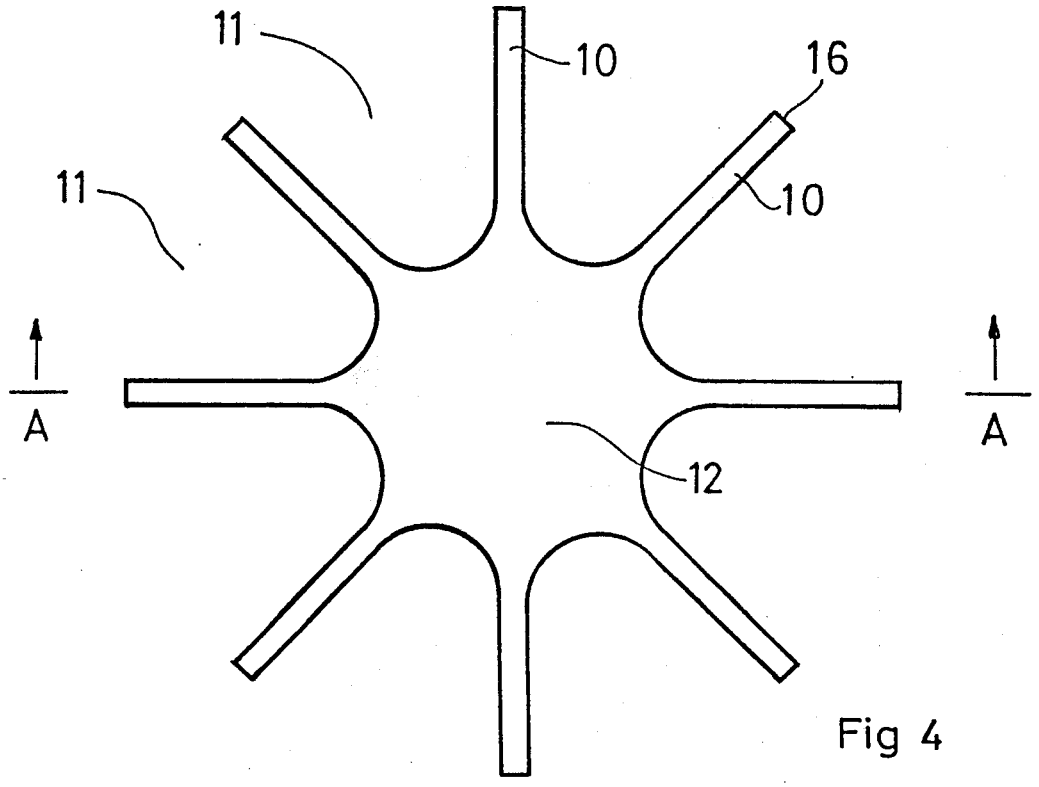
FIG. 4 is a top plan view of the rotor of FIG. 3.

In order to permit the rotor 9 to be rotationally advanced stepwise by reciprocal sweeping of the operating lever 7, there is disposed, in an upper portion 23 of the recess 13 of the rotor, an upper coupling member which, in principle, is designed in the same manner as the lower coupling member 20 and which, therefore, has a number of downwardly directed coupling teeth, of the same number as the coupling teeth 22. The upper coupling member 22 is shown in FIG. 3. It has a cylindrical circumferential surface so that it may be accommodated in the upper portion 23 of the recess and be vertically displaceable therein. The distance of displacement of the upper coupling member need only be sufficient that the coupling teeth can be moved into and out of engagement with one another. In order to rotationally interconnect the upper coupling member with the rotor 9, the upper portion 23 of the recess 13 is provided with axially directed grooves 24 which may be of a greater number than that shown on the Drawing. In engagement with these grooves 24, there are projecting pins or axially directed beads on the circumferential surface of the upper coupling member, so that this member is vertically displaceable in the rotor, but at the same time is rotationally connected therewith.

By sweeping the operating lever 7 reciprocally within the confines as permitted by the opening 6, the coupling teeth 22 will engage with the coupling teeth on the upper coupling member so that the rotor 9 is entrained on pivoting of the operating lever. When this pivoting action is completed and the operating lever is returned to is starting position, the configuration of the teeth will raise the upper coupling member so that, on the return pivotal movement of the operating lever, the rotor 9 will not be moved out of position. When the operating lever 7 subsequently approaches its starting position, the upper coupling member will fall into renewed engagement with the lower, so that a new rotational step for the rotor 9 may be realised by renewed pivotal working of the operating lever 7.

Figure 2:
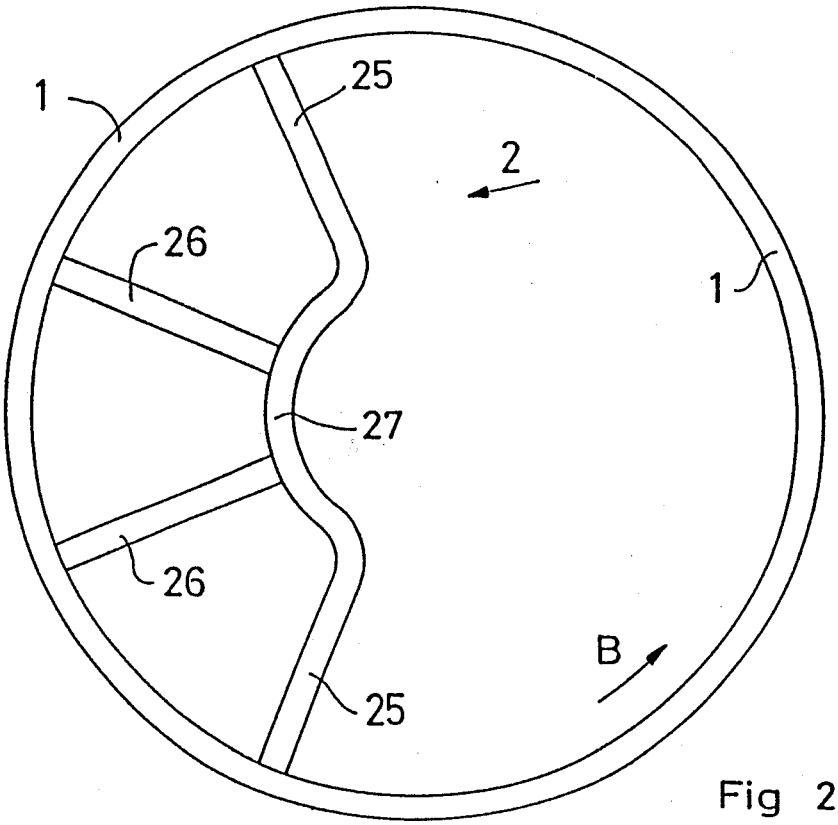
FIG. 2 is a view from beneath of the container included in the subject matter of the present invention and intended to accommodate the goods to be dispensed.

FIG. 2 shows the container 1 seen straight from beneath. It will be apparent from this Drawing figure that the lower contour of the wiper device 2 has two side walls 25 which are approximately radially directed and which are located straight above two vanes 10 when the rotor 9 is in its rest position. The angular distance between the two side walls 25 is selected such that the wiper device covers three immediately adjacent accommodation compartments 11 on the rotor 9. Furthermore, there are provided in the wiper device 2, two sealing walls 26, these also being radially directed and placed in such a manner that, in the rest position of the rotor, they will be located above two vanes 10 on the rotor. Finally, the wiper device 2 also has an inwardly directed side wall 27 which at its lower end, connects to the boss 14 of the rotor and which upwardly inclines out towards the wall of the container 1 at an acute angle of inclination. Thus, the wiper device 2 will greatly taper upwardly, the angle of inclination being selected to be so steep that even relatively hard-packed — or tamped — coffee will slide downwardly along the side wall 27.

The above-described dispensing apparatus functions as follows.

In the starting position and in the rest position, one accommodation compartment 11 is located straight above the discharge opening 8 in the bottom portion 3, at the same time as the operating lever 7 is located in its one end position. Further, both sealing walls 26 will lie as upward extensions of the two vanes 10 which, in the circumferential direction, bound and define the accommodation compartment 11 lying over the discharge opening 8. Correspondingly, the two side walls 25 will form upwardly directed extensions of two further vanes 10 on the rotor 9.

Since the major part of the bottom of the container 1 is covered by a number of upwardly open accommodation compartments 11, the coffee will fall down into these and be borne round with the accommodation compartments when the operating lever 7 and the rotor 9 are rotationally advanced according to the arrow B in FIG. 2. That amount of coffee which is located above the upper edges 15 of the vanes 10 will be wiped off by the leading side wall 25 when the vanes and the accommodation compartments 11 pass in beneath the wiper device 2 so that, in each accommodation compartment 11, there will be a certain determined volume of coffee. For each rotational advancement movement of the operating lever, a new accommodation compartment will be pivoted in beneath the wiper device, at the same time as the filled accommodation compartment already located there is brought to a position directly above the discharge opening 8, such that an emptying of the volume of coffee is effected through this opening.

Figure 5:
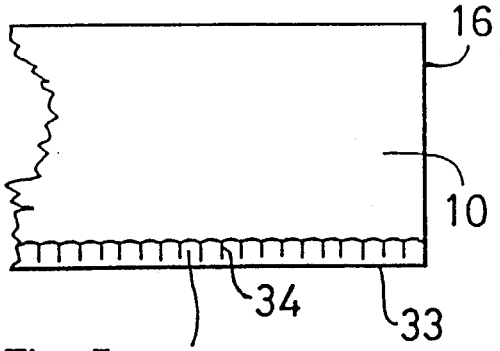
FIG. 5 is a view of an outer end portion of a vane disposed on the rotor, seen from the rear in the direction of movement.
Figure 6:
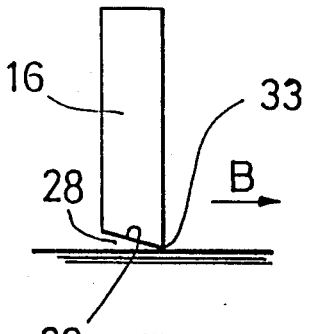
FIG. 6 illustrates the radial outer end surface of the vane illustrated in FIG. 5.

In order to avoid excessively large advancement force requirements on the operating lever 7, the dispensing apparatus should be designed to minimize frictional forces. The lower edges of the vanes 10 and the rotor 9 are shown in FIGS. 5, 6 and the upper half of FIG. 7, and it will be apparent therefrom that the lower leading edge, 33 in the direction of advancement B, has an acute corner angle, so that a rake space 28 is thereby formed beneath the underside of the vane 10. The under edge surface 29 of the vane 10 may, as intimated in FIG. 5, possibly also be provided with grooves 34, at least, in such event, partly up to the leading edge side of the vane. These grooves are not shown in the upper half of FIG. 7, but may, of course, also be employed in the embodiment of that Figure.

Figure 7:
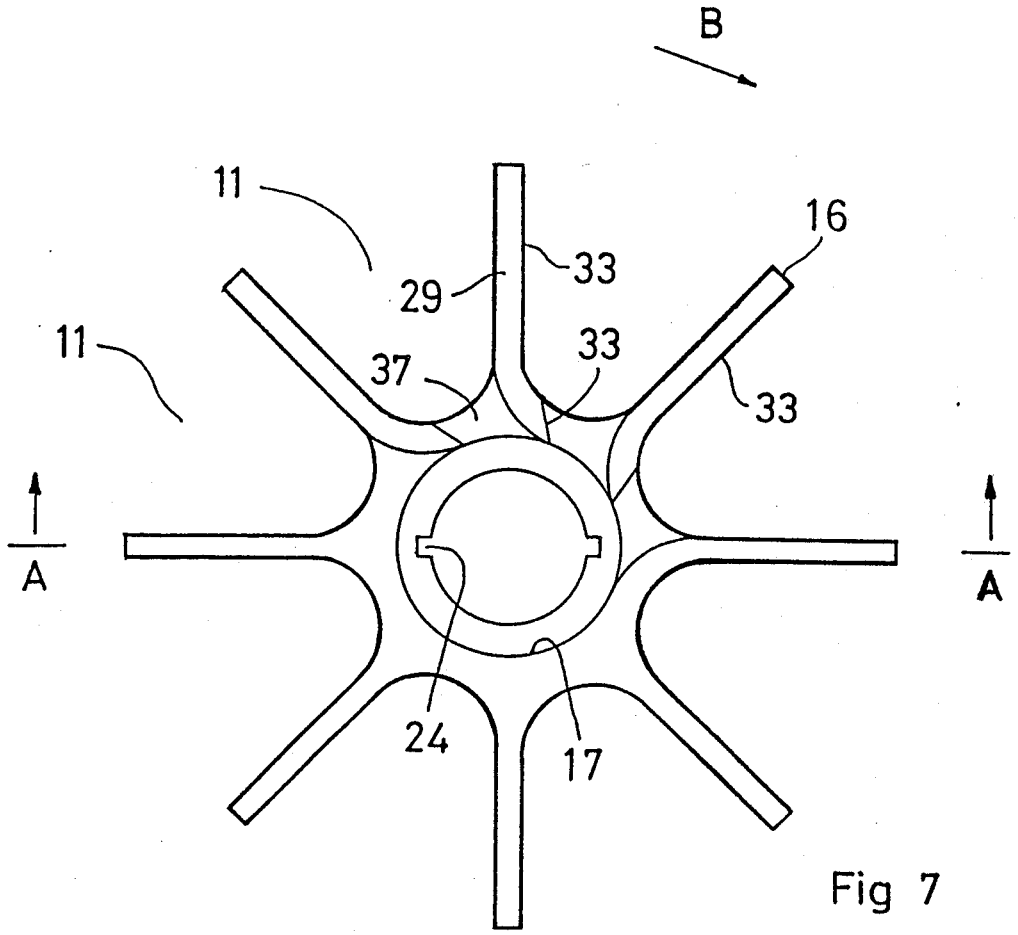
FIG. 7 is a view from beneath of the rotor of FIGS. 3 and 4, the upper half of the Figure showing one preferred embodiment of the lower edges of the vanes, while the lower half of the Figure shows a simplified embodiment.

In the embodiment according to the upper half of FIG. 7, the scraper edge 33 or the leading/lower edges of the vanes 10 at the bottom (the radially inner portions) of the recesses or accommodation compartments 11 extend in towards the edge of the journalling surface 17 such that these inner portions of the scraper edges will be obliquely inclined and swept-back in relation to the radius of the rotor in order to move radially outwardly any possible coffee adhering to the bottom portion 3. Furthermore, as is apparent from FIG. 7, depressions 37 are disposed at the ends of the recesses 11 such that these depressions will be radially inner, and circumferentially extending, continuations of the rake spaces 28.

It will be apparent from the bottom half of FIG. 7 that the rotor 9 and its vanes 10 may also be provided with planar undersides.

Correspondingly with that disclosed above concerning the under edges of the vanes 10, the end surfaces 16 may, of course, also suitably be obliquely inclined so that a rake is formed. Furthermore, the lower edges of the side walls 25 and the sealing walls 26 are suitably also designed in this manner.

In FIG. 1, a closure lid is intimated by broken lines at 30, which lid may be of one-piece construction with the operating lever 7, and which is, hence, pivotal together with the lever. By suitable dimensioning and location of the closure lid 30, the discharge opening 8 is kept closed downwardly when the rotor 9 is in its rest position, while, on the other hand, the closure lid 30 is moved away from the discharge opening at the same time as the rotor 9 is pivotally advanced the next step. When the rotor has subsequently arrived at its fully rotationally advanced new position, the closure lid 30 completely exposes the opening 8 in order, subsequently, to be returned once again so that the opening is covered when the operating lever 7 is moved back to its starting position.

DESCRIPTION OF ALTERNATIVE EMBODIMENTS

FIG. 3 intimates, by broken lines, that the rotor 9 may, in the region of the boss 14, be provided with further vanes 31. These vanes 31 have radially outer edges 32 which, in the intimated embodiment, are disposed to brush against the inwardly directed side wall 27 of the wiper device 2, at least along the lower portion thereof. The risk will hereby be eliminated that any coffee can remain in the region between the boss 14 and the wiper device 2 when the container 1 approaches becoming empty.

In one modified embodiment, the upper defining edges 15 of the vanes 10 need not lie in a conical surface, but may lie in a substantially planar surface which is parallel to the upper side of the bottom portion 3. In such an alternative, the vanes will, thus, be mutually flush in height along the radius. In this embodiment, the wiper device 2 may be designed in a manner differing from that described above and may, in principle, merely consist of a wall lying in a diametric plane on the upper side of the rotor 9, the wall having the contour, seen from above, of a sector, such that it may cover three immediately adjacent accommodation compartments. In order to prevent coffee from accumulating on this approximately radially inwardly projecting wiper blade, there are provided, on the upper side thereof and otherwise rotationally fixed to the rotor 9, projecting arms or vanes which brush against the upper side of the wiper blade. Suitably, these vanes should lie directly above the standard vanes 10 and also extend substantially out to the inner surface of the container 1.

In order to prevent the entire volume of coffee in the container 1 from being caused to rotate as a homogeneous body when the modified rotor is pivoted, there may suitably be provided vanes projecting inwardly from the wall of the container, these being suitably placed, in the vertical direction, as close to the rotor as possible.

In yet a further alternative embodiment - which may be considered as closely related to that described above with reference to FIG. 1, the upwardly directed boss 14 on the rotor 9 is dispensed with and, instead, the wiper device 2 is designed in such a manner that it at least partly covers the approximately circular space formed on the upper side of the hub 12. One such portion of the wiper device 2 extending in over the hub may also serve the purpose of low-friction journalling of the rotor 9 in the axial direction, for example by a tip, a ball or similar arrangement.

If greater freedom of choice is desired concerning the dispensed or advanced amount of coffee or other feedable goods, it is possible, according to the present invention, to render the indexing of the rotor 9 twice as dense, i.e. to provide twice as many vanes 10 and compartments 11. In this alternative, the number of coupling teeth 22 is also doubled, but the size of the discharge opening 8 may be retained or possibly reduced by half. If, with this design of the rotor 9 and the coupling teeth 22, there is provided a movable abutment or arrest which may be inserted in the path of the operating lever 7 so as to block the lever after half of the original movement travel, it is possible hereby optionally to obtain a discharge of one or two compartments on each advancement movement, depending on whether the arrest means is activated or not.

Naturally, it is also possible to render the rotor 9 and the coupling teeth 22 even more finely indexed, for example three or four times the above-indicated index. In these embodiments, it is also possible to employ movable abutment arrest means which, depending upon the current position, permit dispensing with one, two, three or even four compartments on each dispensing sweep of the operating lever 7. Naturally, it is also possible to employ arrest abutments in fixed positions which may optionally be moved to active positions arresting the movement of the operating lever 7.

The present invention should not be considered as restricted to that described above and shown on the Drawings, many modifications being conceivable without departing from the spirit and scope of the appended claims.

What is claimed is:

1. A dispensing apparatus for dispensing pulverent goods such as ground coffee, comprising:

a container for receiving the goods and having a bottom with a discharge opening therein, a rotor rotatably provided in the container and covering substantially the whole bottom thereof, said rotor having a number of radially extending vanes defining compartments therebetween for receiving the goods, a drive mechanism for rotating said rotor in rotational steps which each correspond to the length of one compartment, said drive mechanism being operable to move the rotor to a plurality of stop positions which are located as to place consecutive compartments of the rotor in registration with said discharge opening, said rotor having a bore in its center, said drive mechanism including an upper coupling member which is axially slidable but non-rotatable in said bore, a lower coupling member connected to an operating lever and being provided with teeth, said upper coupling member having a member of teeth for engaging corresponding teeth on the lower coupling member, the teeth being operable to connect the two coupling members rotationally together when the lever is being pivoted in one direction to advance the rotor one step but to disengage the upper coupling member by axially lifting it when the lever is pivoted in the other direction, a wiper means fastened to said container and covering a portion of the rotor in the region of the discharge opening, said wiper means having a wall facing the interior of said container, said wall sloping from a region above the center of the rotor upwardly to join the wall of said container at an acute angle.

2. The dispensing apparatus of claim 1 wherein said lever has an extension beyond said lower coupling member, said extension having a closure member which closes the discharge opening when the rotor is stopped, said closure member being movable to open said discharge opening in response to movement of the lever to advance the rotor one step.

3. A dispensing apparatus for dispensing pulverent goods such as ground coffee, comprising:

a container for receiving the goods and having a bottom with a discharge opening therein, a rotor rotatably provided in the container and covering substantially the whole bottom thereof, said rotor having a number of radially extending vanes defining compartments therebetween for receiving the goods, a drive mechanism for rotating said rotor in rotational steps which each correspond to the length of one compartment, said drive mechanism being operable to move the rotor to a plurality of stop positions which are located as to place consecutive compartments of the rotor in registration with said discharge opening, said rotor having a bore in its center, said drive mechanism including an upper coupling member which is axially slidable but non-rotatable in said bore, a lower coupling member connected to an operating lever and being provided with teeth, said upper coupling member having a number of teeth for engaging corresponding teeth on the lower coupling member, the teeth being operable to connect the two coupling members rotationally together when the lever is being pivoted in one direction to advance the rotor one step but to disengage the upper coupling member by axially lifting it when the lever is pivoted in the other direction, a wiper means fastened to said container and covering a portion of the rotor in the region of the discharge opening.

4. The dispensing apparatus of claim 3 wherein said container is substantially cylindrical, said wiper means having a surface extending into the container to prevent said goods from rotating as a body under influence of said rotor.

* * * * *